United States Patent [19]

Decker

[11] 4,021,020

[45] May 3, 1977

[54] ROAD BARRICADE AND METHOD OF MAKING SAME

[76] Inventor: Floyd V. Decker, P.O. Box 790, Arnold, Calif. 95223

[22] Filed: Apr. 5, 1976

[21] Appl. No.: 673,969

[52] U.S. Cl. ..... 256/1; 256/64; 40/125 M

[51] Int. Cl.[2] ..... E01F 9/00

[58] Field of Search ..... 404/9, 10; 116/63 P, 116/63 T; 40/125 M, 125 N; 256/64, 13.1, 1

[56] References Cited

UNITED STATES PATENTS

| | | | |
|---|---|---|---|
| 2,864,331 | 12/1958 | Brands | 116/63 P |
| 3,692,281 | 9/1972 | Clayton | 256/64 |
| 3,880,406 | 4/1975 | Stehle | 116/63 P X |

*Primary Examiner*—Andrew V. Kundrat
*Attorney, Agent, or Firm*—Phillips, Moore, Weissenberger

[57] ABSTRACT

An inexpensive, substantially indestructible road barricade which will cause reduced damage to an automobile upon collision therewith is disclosed. The method of making such road barricade in large numbers with uniform configuration from used automobile tires is also disclosed and the preferred configuration for the barricade is described.

8 Claims, 4 Drawing Figures

ROAD BARRICADE AND METHOD OF MAKING SAME

BACKGROUND OF THE INVENTION

This invention relates to highway traffic channelizing devices of the barricade type and more particularly to a road barricade which is portable, substantially indestructible and which will not damage a moving vehicle upon collision therewith, as well as to the method of inexpensively manufacturing such barricade in larger quantities of substantially uniform configuration.

Traffic channelizing devices have three basic functions, first, to separate vehicles from hazards such as wrong-way traffic or those created by construction or maintenance activities in or near a traveled way, second, to provide protection for men working in or near a traveled way and third, to guide and direct traffic for purposes other than safety. Obviously, devices designed solely for the third function should merely give a visual indication of the desired flow of traffic but should not be substantial enough to damage a vehicle which collides with them for any reason, particularly inadvertence or inattention of the driver.

However, in order to fulfill the first two functions, it would be necessary for the traffic channelizing device to possess an impossible dual attribute, namely, the ability to absolutely protect workmen on or near the highway from injury by a vehicle which leaves the desired roadway and at the same time avoid creating a hazard to vehicles traveling along the highway.

As a result, a total system of traffic control has developed in which channelizing devices such as light weight, brightly colored, plastic cones that will not inflict any severe damage on a vehicle that strikes them are used to provide a smooth and gradual transition into the desired roadway with progressively more substantial barricades positioned down the traffic stream toward hazard, equipment or workmen. For example, proceeding downstream in the traffic channelizing system the traffic cones may be replaced by painted barrels or drums which are in turn replaced by wooden or metal barricades first in a portable sawhorse configuration, then in a movable sled configuration and finally in a fixed fence-like configuration. The kind of barricade used should be selected in view of the hazard being protected against, and in no case should a barricade be used where a collision with the barricade would produce a more severe injury or damage than a collision with the hazard, equipment or workmen which the system is designed to avoid.

According to this invention, a road barricade suitable for use in a wider range of intermediate points in a total traffic control system is provided. The road barricade of this invention is as substantial in configuration and appearance as the wooden or metal sawhorse type barricade of the prior art and yet upon collision will inflict less damage on a vehicle, and will be damaged less by the vehicle, than the barrel or drum type of traffic channelizing device. In fact, the road barricade of this invention approaches the plastic traffic cone in terms of minimizing damage, good durability, and low cost but yet retains the advantage of the more expensive sawhorse type barricade structures in terms of configuration and appearance.

It is a matter of considerable importance that traffic channelizing devices have a uniform appearance so that they can be easily recognized and understood by the drivers of vehicles. According to this invention, a method of making the road barricades inexpensively of highly durable material and of uniform shape and size is provided.

SUMMARY OF THE INVENTION

Briefly, according to this invention, a road barricade comprises sidewall portions cut from vehicle tires of comparable size and each including one circular bead thereof. Thus the sidewall portions have a convex major surface which formed a portion of the exterior surface of the tire and a concave major surface which formed a portion of the interior of the tire. Two of such sidewall portions are joined to each other by fastening means with their convex major surfaces adjacent each other and their circular beads in substantially coaxial alignment. According to this invention, the joint between the two sidewall portions is limited to a sector defining less than 180° of the periphery of the circular beads thereof. The sidewall portions may be provided with a preferred peripheral configuration, may be painted as desired and may have various accessory devices attached thereto.

BRIEF DESCRIPTION OF THE DRAWING

The foregoing and other objects and features of the subject invention will be more fully understood from the following detailed description of a preferred embodiment when read in conjunction with the attached drawings wherein.

DETAILED DESCRIPTION OF PREFERRED EMBODIMENTS

Figure 1:
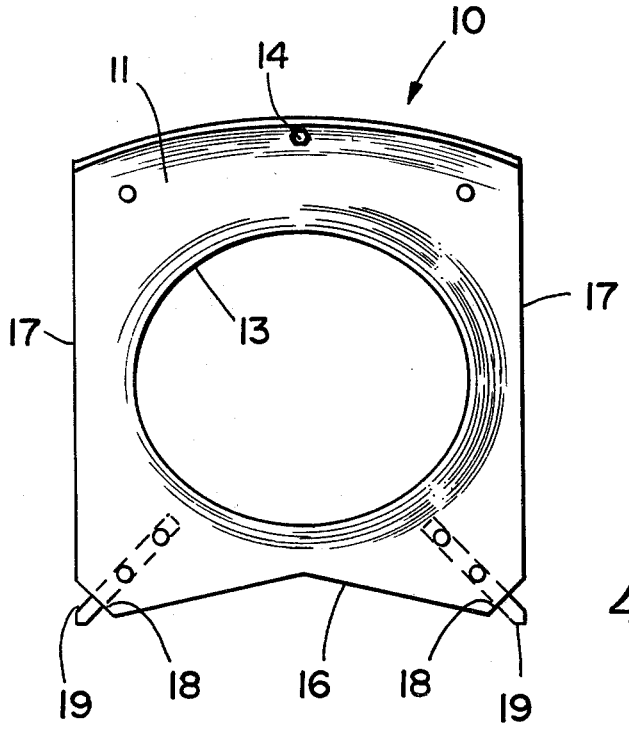
FIG. 1 is a front view of a preferred embodiment of the road barricade made in accordance with the teaching of this invention.

According to the teaching of this invention, an improved road barricade may be made from discarded rubber tires of the type used on automobiles, trucks and other highway vehicles. According to a preferred embodiment of this invention, a worn out tire carcass is mounted by an appropriate means for rotation about its normal axis. A pair of spaced knife edges are then forced against the tread portion of the tire while the tire is being rotated in order to separate the sidewall portions of the tire from the tread portion thereof. In other words, an annular tread portion about 3 inches (about 8 cm.) wide is cut from the tire carcass and discarded, leaving a pair of apertured disc-like sidewall portions having opposed major surfaces. The circular bead portion of the tire which was adapted to engage the wheel rim forms the aperture through the disc-like sidewall portions with the major surface of the sidewall portion which formed part of the interior surface of the tire being generally concave and the major surface of the sidewall portion which formed part of the exterior of the tire being generally convex.

According to the teaching of this invention, the orientation of the sidewall portions with respect to each other are reversed so that their convex major surfaces are adjacent each other. The two sidewall portions are then affixed to each other with their circular beads or apertures in substantially coaxial alignment. According to the teaching of this invention, the two sidewall portions are affixed to each other only within a sector defining less than 180° of the periphery of their circular bead portions or, in other words, on one side of the axis of the circular bead or aperture. Thus, the sidewall portions at the other side of the axis of the circular bead or aperture may be spread apart to provide a generally triangular free-standing structure in side view, as best shown in FIG. 2 of the drawing.

However, such structure would tend to be unstable due to the circular outer periphery of the sidewall portions and thus, referring to FIG. 1 of the drawing, it is preferred that a part of the sidewall portions be removed directly opposite from the means fastening the two sidewall portions to each other in order to provide a generally rectilinear ground engaging surface to improve the stability of the free-standing structure. In addition, according to the preferred embodiment of this invention, as shown in the drawing, additional parts of the sidewall portions may be removed to facilitate storage and handling of the road barricade and reduce the weight thereof.

Referring to the preferred embodimen t of this invention as shown in the drawing, it will be seen that the road barricade 10 comprises a pair of sidewall portions 11 and 12 cut from a vehicle tire carcass as described hereinabove. Thus, each sidewall portion 11, 12 includes the circular bead 13 or rim mounting aperture of the tire. The sidewall portions 11, 12 are preferably cut from the same tire carcass, however, they may also be sidewall portions from different tire carcasses of comparable size.

Figure 2:
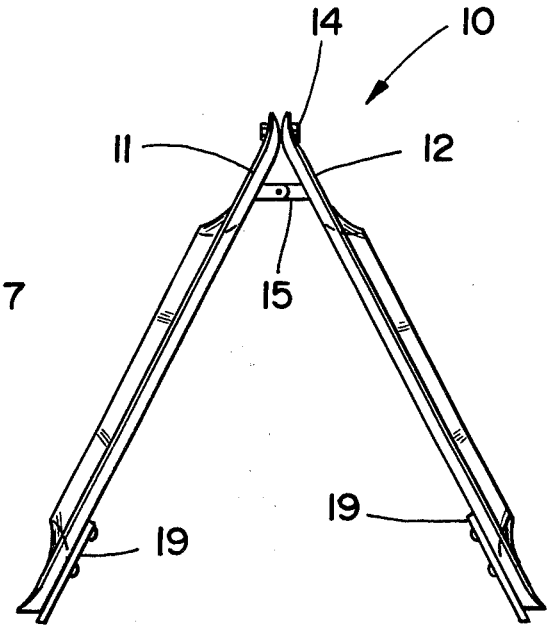
FIG. 2 is a side view of the road barricade of FIG. 1.
Figure 3:
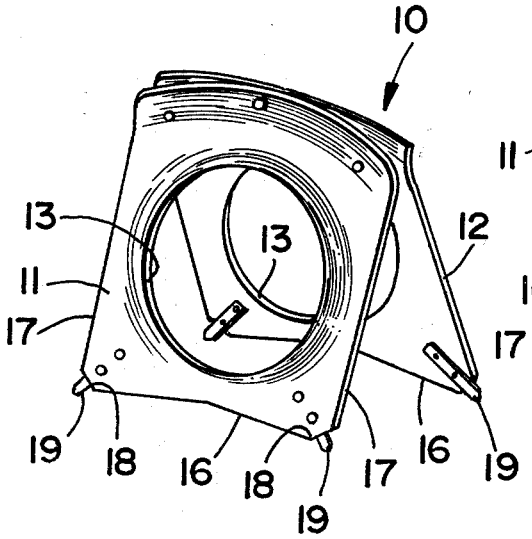
FIG. 3 is a perspective view of the road barricade of FIG. 1.

As best shown in FIGS. 2 and 3, the convex or former exterior major surfaces of the sidewall portions 11 and 12 are arranged adjacent each other and the sidewall portions 11 and 12 are affixed to each other on one side of the circular bead 13 as by means of one or more bolts 14 passing therethrough, for example. For greater stability, a conventional scissors-type hinge structure may be interposed between and interconnect the sidewall portions 11 and 12 at one side of the circular bead 13.

In use, that part of the sidewall portions opposite the means fastening them together is spread apart and placed in contact with the ground or other supporting surface to provide a free-standing structure. The hinge structure 15 may be adapted to maintain the separation between the sidewall portions 11 and 12 in use and the hinge structure 15 may be folded to enable the sidewall portions 11 and 12 to be brought together for transportation or storage of the road barricade 10.

Figure 4:
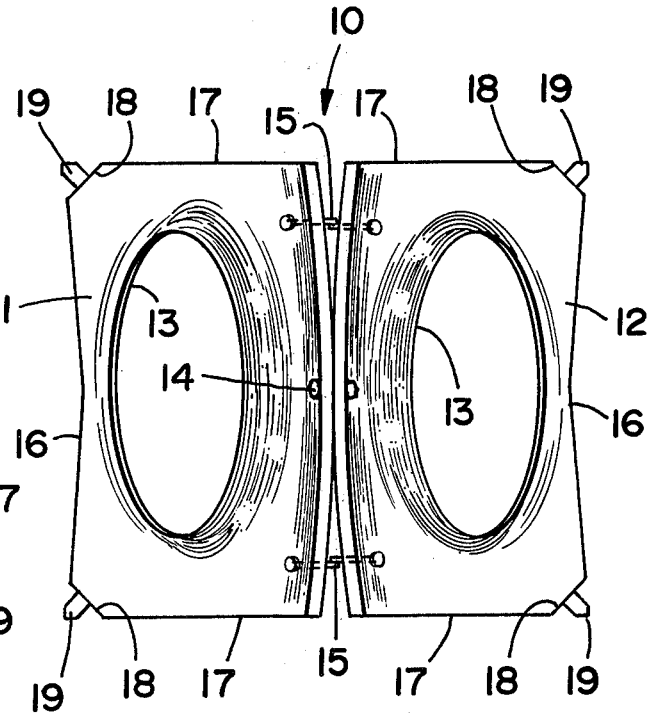
FIG. 4 is a top view of the road barricade of FIG. 1.

As best shown in FIGS. 1, 3 and 4, the sidewall portions 11 and 12 may be trimmed to remove bottom and side parts thereof in order to increase the stability of the road barricade 10 in use and to simplify the transportation and storage thereof as well as to reduce unnecessary weight. Thus, as shown in FIG. 1, the bottom part of the sidewall portions 11 and 12 directly opposite the bolt 14 which fastens the portions together may be removed to provide a generally rectilinear and generally chordal edge the perpendicular bisector of which passes through the center of the circular bead 13 and the bolt 14. In order to provide for two-point engagement with the ground which would be desirable for engaging a rough or uneven supporting surface, the generally chordal bottom edge 16 is not strictly rectilinear but may be curved toward the center of the sidewall portions or be formed by parts of two larger intersecting chords as best shown in FIG. 1.

Vertical edges 17 may also be provided on the sidewall portions 11 and 12 by removing appropriate parts of the sidewall portions 11 and 12. The desired parts of the sidewall portions 11 and 12 may be conveniently removed by placing the sidewall portions under a conventional guillotine-type cutting knife prior to assembling the sidewall portions with each other.

Finally, for long life and optimum stability, the corners formed by the intersection of the vertical edges 17 with the bottom 16 of the tire portions 11 and 12 may be removed to provide an angular interconnecting edge 18. Appropriate points or legs 19 of strap metal may then be bolted to the convex adjacent surfaces of the sidewall portions 11 and 12 and extend radially in a downward direction as shown in the drawing to engage the ground or other supporting surface.

Appropriate holes may, of course, be drilled through the sidewall portions 11 and 12 in appropriate locations to receive bolts 14 for affixing the sidewall portions to each other and for mounting the hinges 15 and strap metal legs or points 19. Also, the concave or exposed surfaces of the sidewall portions may be painted with appropriate colors and in appropriate configurations to correspond to the usual markings of road barricades.

Since the road barricade 10 of this invention is made primarily of rubber, very little damage will result either to a vehicle or to the road barricade 10 upon collision of a vehicle therewith. Thus, the road barricade 10 according to this invention will have an extended life in comparison to the metal or wooden road barricades currently in use. On the other hand, the size and configuration of the road barricade 10 according to the teaching of this invention approaches the size and configuration of the wooden or metal sawhorse type barricades currently in use and will tend to have the same visual impact and effectiveness in channelizing traffic.

The road barricade 10, according to the teaching of this invention, may be simply and inexpensively made by simple cutting techniques from discarded tire carcasses. Thus, even the preferred embodiment of this invention as shown in the drawing will be far less expensive than conventional wooden or metal sawhorse type road barricades and will have the advantage of much longer life in actual use.

It is believed that those skilled in the art will make obvious modifications in the preferred embodiment of this invention as shown in the drawing and in the method of making a road barricade according to the teaching of this invention to suit their particular needs. However, the basic features of this invention, namely, the removal of the sidewall portions of tire carcasses and the affixing thereof to each other in reverse orientation at one side of the circular bead thereof are essential to all embodiments of this invention.

In the preferred embodiment of this invention as shown in the drawing, the road barricade is made of sidewall portions cut from standard automobile tire carcasses. The means fastening the sidewall portions together are limited to a first sector defining less than about 90° of the periphery of the bead 13 and a sidewall portion. Similarly, the part of the sidewall portion removed opposite the fastening means is confined to a second sector directly opposite the first sector defining less than about 90° of the periphery of the bead 13 and sidewall portion.

Thus, a road barricade about 36 inches (about 0.9 meter) high in its normal position in use is provided according to the preferred embodiment of this invention. In addition, in the preferred embodiment, parts of the sidewall portions are removed along chords which extend generally vertically along opposite sides of the road barricade in its normal position in use to provide a barricade having a horizontal width of about 32 inches (about 0.8 meter). Flasher lights or other warning devices may be mounted on top of the road barricade in use either by affixing them to one or both of the sidewall portions or by fastening appropriate supporting elements thereof between the sidewall portions. Thus, a plurality of road barricades may be simply and inexpensively made according to the teaching of this invention all with uniform configuration for use in a particular traffic channelizing system.

What is claimed is:

1. A road barricade comprising a first sidewall portion of a given size separated from a vehicle tire, said first sidewall portion including one circular bead and having a convex major surface and an opposite concave major surface; a second sidewall portion separated from a vehicle tire of a size comparable to said given size vehicle tire, said second sidewall portion including one circular bead and having a convex major surface and an opposite concave major surface; and fastener means joining said first and said second sidewall portions to each other with said circular beads thereof in substantially coaxial alignment and said convex major surfaces thereof adjacent and facing each other, said fastener means being located within a sector defining less than 180° of the periphery of said circular beads thereof.

2. A road barricade as claimed in claim 1 wherein corresponding parts of each of said first and second sidewall portions opposite said fastener means are removed.

3. A road barricade as claimed in claim 2 wherein said corresponding parts are removed from each of said first and second sidewall portions generally along first chordal lines the perpendicular bisectors of which bisect said sector defining less than 180° of the periphery of said circular beads thereof.

4. A road barricade as claimed in claim 3 wherein further corresponding parts of each of said first and second sidewall portions are removed along generally chordal second and third lines extending generally perpendicular to said first lines at opposite ends thereof.

5. A road barricade as claimed in claim 1 wherein said fastener means comprises a hinge structure interposed between said first and second sidewall portions.

6. A road barricade as claimed in claim 4 wherein said fastener means are located within a sector defining less than about 90° of the periphery of said circular beads of said sidewall portions and said first chordal lines lie within sectors defining less than about 90° of the periphery of said circular beads of said sidewall portions.

7. A road barricade as claimed in claim 6 wherein said second and third chordal lines lie within sectors defining about 90° of the periphery of said circular beads of said sidewall portions.

8. A road barricade as claimed in claim 7 wherein said road barricade includes a plurality of strap metal legs each mounted on a sidewall portion and projecting therefrom at a different one of the four corners provided by said first, second and third chordal lines.

* * * * *